United States Patent [19]

Szymczak

[11] Patent Number: 4,970,390

[45] Date of Patent: Nov. 13, 1990

[54] APPARATUS FOR COUNTING INDIVIDUAL PARTICLES IN TIME-OF-FLIGHT SPECTROMETRY, AND METHOD OF USE

[75] Inventor: Wilfried Szymczak, Lohhof, Fed. Rep. of Germany

[73] Assignee: Gesellschaft für Strahlen- und Umweltforschung mbH (GSF), Neuherberg, Fed. Rep. of Germany

[21] Appl. No.: 480,056

[22] Filed: Feb. 14, 1990

[30] Foreign Application Priority Data

Feb. 14, 1989 [DE] Fed. Rep. of Germany ..... 3904308

[51] Int. Cl.[5] ..... H01V 49/40

[52] U.S. Cl. ..... 250/287; 250/282; 250/281

[58] Field of Search ..... 250/287, 282, 281

[56] References Cited

U.S. PATENT DOCUMENTS 4,894,536 1/1990 Conzemius ..... 250/282

OTHER PUBLICATIONS

Price et al., "Recent Developments in Techniques Utilizing Time-of-Flight Mass Spectrometry", Int. Journal of Mass Spect. & Ion Processes, 60 (1984), pp. 61–81.

Macfarlane et al., "Cf-Plasma Desorption Time-of-Flight Mass Spectrometry", Int. Journal of Mass Spectr. & Ion Processes, 21 (1976), pp. 81–92.

*Primary Examiner*—Jack I. Berman

*Attorney, Agent, or Firm*—Spencer & Frank

[57] ABSTRACT

An apparatus for counting individual particles in time-of-flight mass spectrometry includes a device for producing secondary particles at a high repetition rate by pulsed ion bombardment of a sample from which the secondary particles originate, an accelerator for accelerating the secondary particles, and a detector for detecting arrival of the secondary particles and producing an output signal indicating detection of a secondary particle. The output signal of the detector has a magnitude which is independent of the number of simultaneously impinging secondary particles. A fast pulse amplifier recieves the output signals and amplifies them. A fast discriminator receives the amplified signals and converts them into unit pulses, and supplies the converted signal to a shifting and attenuating device, for shifting and attenuating the unit pulses in a selected time relationship so that a noise-distorted base line of the unit pulses does not lie in a predetermined measuring range, and so that a plateau of the unit pulses lies in the predetermined measuring range. A transient recorder fed by the shifting ad attenuating device produces an output signal at a high voltage level for a short time interval in response to each of the shifted and attenuated unit pulses, representing a mass spectrum of the secondary particles.

8 Claims, 3 Drawing Sheets

0

0

0
δt 0
0
t

APPARATUS FOR COUNTING INDIVIDUAL PARTICLES IN TIME-OF-FLIGHT SPECTROMETRY, AND METHOD OF USE

CROSS-REFERENCE TO RELATED APPLICATION

The present disclosure relates to the subject matter disclosed in German Application No. P 39 04 308.8 of Feb. 14th, 1989, the entire specification of which is incorporated herein by reference.

BACKGROUND OF THE INVENTION

The present invention relates to a method of counting individual particles in time-of-flight mass spectrometry for secondary ions or particles occurring at a high repetition rate after pulsed ion bombardment of a sample, with a detector being operated to measure the time-of-flight of the secondary particles in such a manner that the magnitude of the detector signal becomes independent of the number of simultaneously impinging secondary particles and all detector signals detected after an individual ion bombardment are recorded by a recording device.

In time-of-flight mass spectrometry, the important measuring task is a precise measurement of the time-of-flight of secondary particles between a time $t_0$ at which they are generated and a time $t_i$ at which they impinge on the detector. The elapsed time between the times $t_i$ and $t_0$ is a function of the particle's m/z ratio, where m represents the particle mass. If z is 1, the dependence of the particle's velocity is essentially on its mass. The frequency distribution of the time-of-flight of the secondary particles with respect to the elapsed time is a representation of the mass spectrum.

In time-of-flight mass spectrometry, essentially two different methods are employed to record the arrival times of the secondary particles, and these methods are discussed hereunder.

An article entitled "Recent Developments in Techniques Utilising Time-of-Flight Mass Spectrometry" by D. Price and G. J. Milnes, in Int. J. Mass Spectrom. Ion Proc. 60 (1984), incorporated by reference in the present application, discloses an analog recording method for recording arrival times of secondary particles. In this analog recording method, the particle detector which is employed operates as a linear amplifier. The amplitude of the detector signal is here proportional to the number of particles impinging on the detector per unit time. A fast transient recorder which is started by a signal correlated with the starting time $t_0$ of a starting event—which may be the detection of a fission fragment—records the detector signal. The "stop" event in this arrangement can be the detection of a secondary ion whose creation involves the generation of the fission fragment mentioned above. In this apparatus, a signal amplitude as well as an associated elapsed time is digitalized in successive short time intervals and is stored. After the starting event, a complete time-of-flight spectrum is customarily recorded and stored in the memory of the fast transient recorder.

An article entitled "Cf-Plasma Desorption Time-of-Flight Mass Spectrometry" by R. D. Macfarlane and D. T. Torgerson, in Int. J. Mass Spectrom. Ion Phys. 21 (1976), incorporated by reference in the present application, discloses the counting of individual particles. In this article a detector is discussed which is operated in saturation and which generates a signal which is independent of the number of secondary ions or particles impinging on the detector per unit time. A subsequent fast discriminator emits a unit pulse per stop event to a stop input of a time/digital converter TDC. By summing up the stop events of several measuring cycles each actuated by the start event at the starting time $t_0$, high signal to noise ratios can be realized.

In the analog recording method, the signal to noise ratio is limited to about two orders of magnitude because of the noise of the analog signals and the low amplitude resolution of the transient recorders.

In the individual particle counting method, the number of processible stop times per start recording cycle is limited. Moreover, stop events arriving within the relatively long dead time of about 50 ns after an event are not recorded.

SUMMARY OF THE INVENTION

It is an object of the present invention to provide a method of counting individual particles which is distinguished by a high signal to noise ratio and in which the derived mass spectrum is not falsified by suppression of events occurring during dead times of the instrument.

The above and other objects are accomplished according to the invention in that an apparatus for counting individual particles in time-of-flight mass spectrometry, includes:

means for producing secondary particles at a high repetition rate, e.g. by pulsed ion or laser bombardment of a sample from which the secondary particles originate;

means for accelerating the secondary particles;

detector means for detecting arrival of the secondary particles and producing an output signal indicating detection of a secondary particle, the output signal of the detector means having a magnitude which is independent of the number of simultaneously impinging secondary particles;

fast pulse amplifier means for amplifying the output signals from the detector means;

fast discriminator means for conversion of the amplified output signals produced by the fast pulse amplifier means into unit pulses;

shifting and attenuating means fed by the fast discriminator means for shifting and attenuating the unit pulses in a selected time relationship so that a noise-distorted base line of the unit pulses does not lie in a predetermined measuring range, and so that a plateau of the unit pulses lies in the predetermined measuring range; and transient recorder means fed by the shifting and attenuating means, for producing an output signal at a high voltage level for a short time interval in response to each of the shifted and attenuated the unit pulses, representing a mass spectrum of the secondary particles.

The advantages of the method according to the invention are, in particular, that all particles impinging on the detector after a start signal are detected and that the statistical error of the individual mass peaks can be made to be almost as small as desired in that averages are formed over very many measuring cycles.

The invention will be described in greater detail below with reference to an embodiment which is illustrated in the drawings.

DETAILED DESCRIPTION OF THE PREFERRED EMBODIMENT

Figure 1:
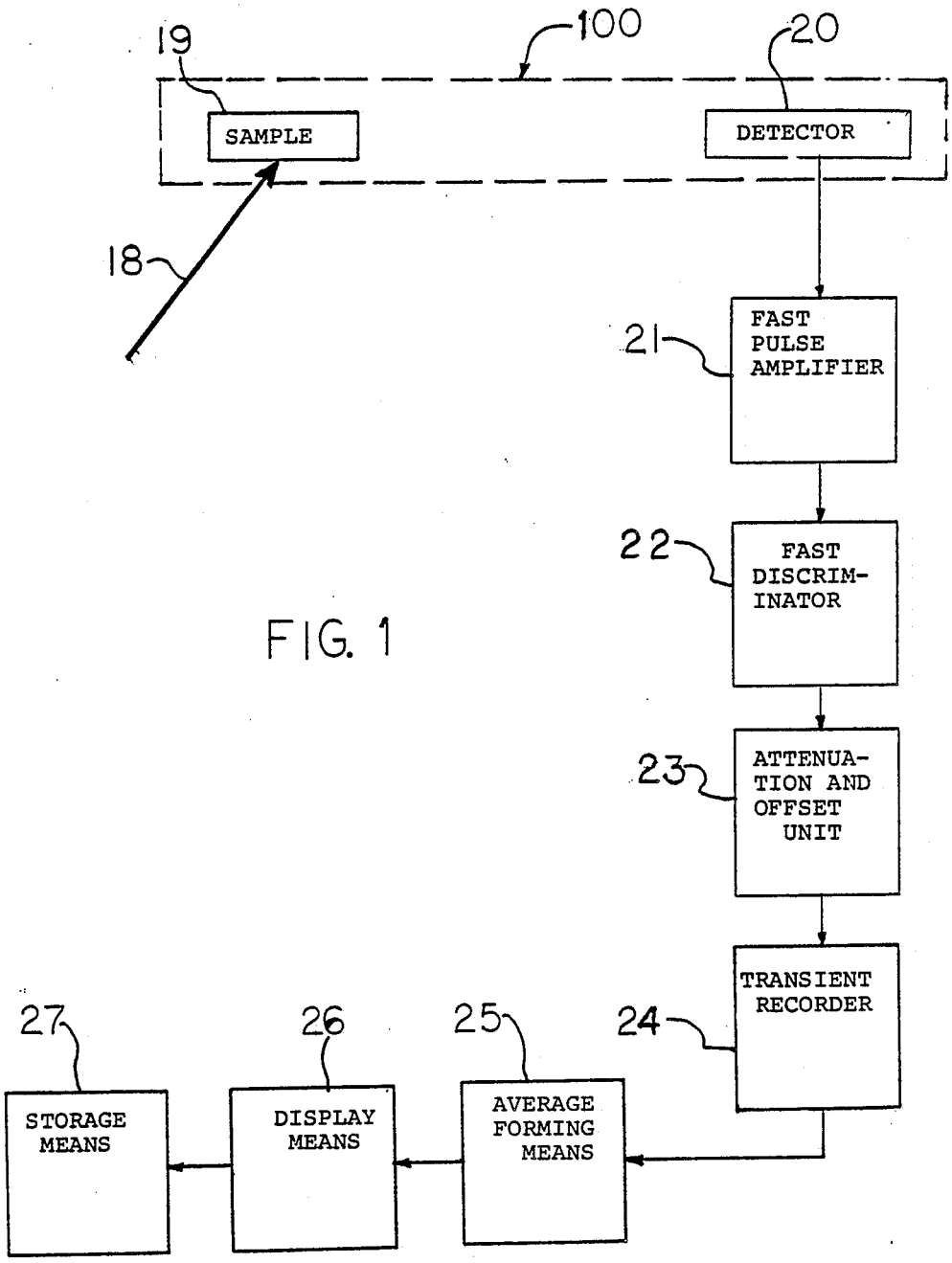
FIG. 1 schematically illustrates an apparatus used in the method according to the present invention.

FIG. 1 schematically illustrates an apparatus according to the invention, in which a pulsed primary ion beam 18 (having a pulse duration of about 5 ns) is directed onto a sample 19. The sample 19 and a detector 20 are attached to opposite ends of a time-of-flight tube 100 preferably having a length of 20 cm. The secondary particles (not shown) desorbed and ionized by the primary ion beam 18 are post-accelerated in the direction of the detector 20 in an electrical field between the sample 19 disposed at an elevated position relative to the time-of-flight tube 100 and a grounded grid (not shown) disposed in front of it. The time-of-flight $t_i$ elapsed during travel of a secondary ion from the surface of the sample 18 to a point of impingement on the detector 20 varies as a function of the mass of the secondary ion. The detector 20 is operated in saturation.

The detector 20 produces output signals in response to detection of arrival of the secondary particles and supplies the output signals to a fast pulse amplifier 21 whose rise and decay time is less than or equal to 2 ns. The fast pulse amplifier 21 in turn feeds output signals to a fast discriminator 22 which in turn feeds its output signal to an attenuation and offset unit or means 23. The attenuation and offset unit 23 in turn supplies output signals to a transient recorder 24. The transient recorder 24 has a digitalization time or interval $\delta t$.

Figure 2:
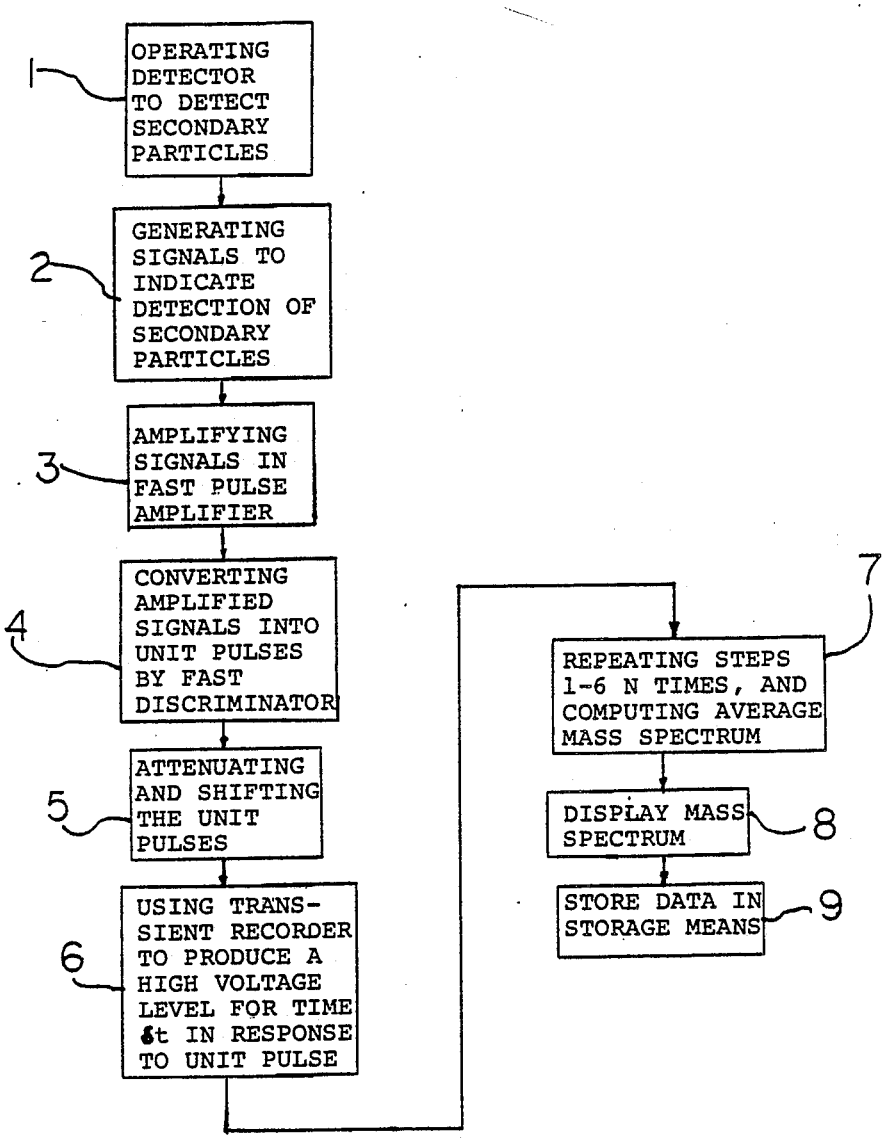
FIG. 2 illustrates a method for determining a mass spectrum according to the invention.

Method steps for use of the invention of FIG. 1 are illustrated in FIG. 2, and include as a first step 1 operating the detector 20 to detect impinging secondary particles, followed at step 2 by generation of output signals representing detection of the secondary particles in the detector 20. In step 2, the detector 20 generates an output signal whose magnitude is independent of the number of secondary particles impinging per unit time. Accordingly, for an accurate representation of the mass spectrum, care must be taken that not more than one particle impinges on the detector 20 per measurement.

The output signals of the detector 20 which are produced at step 2 are amplified at step 3 in the fast pulse amplifier 21 to produce amplifier output signals. In step 4, these amplifier output signals are converted by a fast discriminator 22 into unit pulses. These unit pulses have a half-width which is less than or equal to the digitalization time $\delta t$ of the transient recorder 24. Accordingly, the double pulse resolution of the fast discriminator 22 is less than the time interval corresponding to the digitalization time $\delta t$. In this way, it is ensured that the time resolution in the recorded time-of-flight spectrum is limited only by the digitalization time $\delta t$ of the transient recorder 24.

In step 5, the unit pulses produced by the fast discriminator 22 are attenuated and shifted by the attenuation and offset unit 23 so that a noise-distorted base line of the unit pulses will not lie within the measuring range of the transient recorder 24, and so that the plateaus of the unit pulses produced by the fast discriminator 22 fall within the measuring range of the transient recorder 24.

At step 6, assuming that particles were detected at step 1, the transient recorder 24 produces a high voltage level at the time $t_i$ for the duration of the digitalization time or measuring interval $\delta t$. The transient recorder 24 produces a low or zero signal level at times where no particles are detected in step 1. The signal sequence recorded in the transient recorder 24 after a starting time $t_0$ corresponds to a time-of-flight spectrum which constitutes digital information (i.e., as "yes-no" information) relating to detection of the secondary particles at the detector 20 as a function of their time-of-flight.

Steps 1–6 are repeated for a plurality of secondary particles so that, in step 7, the average-forming means 25 forms an average spectrum of a number N (which is preferably a large number) of the time-of-flight spectra which are obtained in the repeated preceding steps 1–6. This average spectrum has a signal level which is a direct measure of the number of particles having a given time-of-flight $t_i$ which corresponds to a given particle mass $M_i$. The signal to noise ratio is determined only by N, rather than by the amplitude resolution of transient recorder 24 or the electronic noise which may be present.

In a further step, step 8, the average spectra determined at step 7 are displayed by a display means 26. The average spectra determined at step 7 can additionally be stored as indicated at step 9 by a storage means 27 at the same time or after it is displayed. While the display means 26 is used in the preferred embodiment and includes a display screen, this step can be omitted and the determined average spectra can instead be stored in the storage means 27.

Figures 3A, 3B, 3C, 3D:
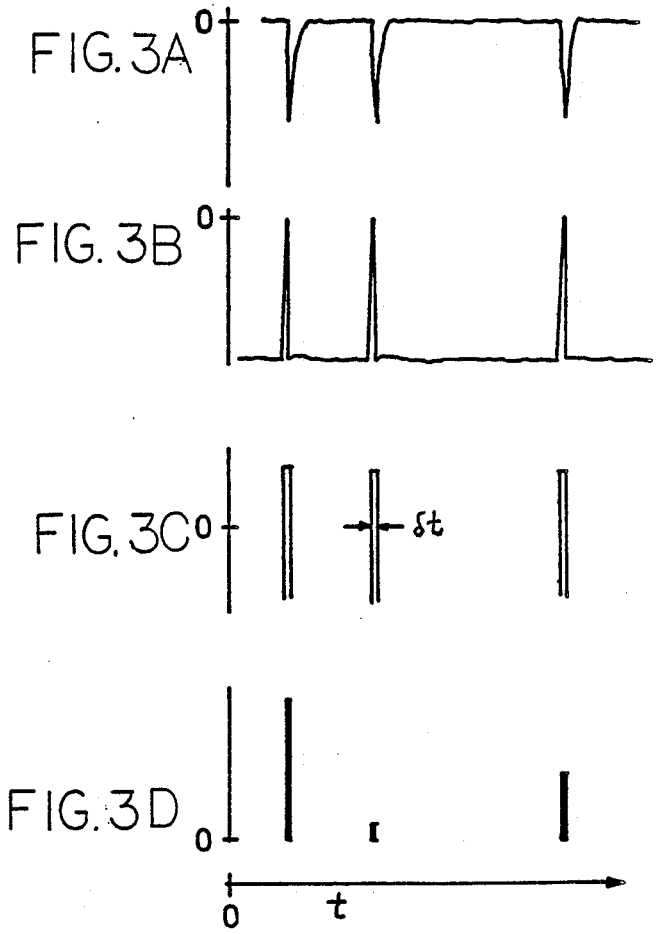
FIG. 3A is an illustration of a time-of-flight spectrum produced by use of the method of FIG. 2 at the output of a pulse amplifier.
FIG. 3B is an illustration of a spectrum of discriminator pulses produced according to the method of FIG. 2.
FIG. 3C depicts an individual spectrum produced according to the method of FIG. 2 as it is stored within the transient recorder schematically shown in FIG. 1.
FIG. 3D illustrates an averaged spectrum produced according to the method of FIG. 2.

FIG. 3A depicts a arbitrary part of a time-of-flight spectrum as it would exist at the output of the fast pulse amplifier 21. The negative peaks correspond to amplified, saturated detector signals in response to detection of arrival of the secondary particles at different time-of-flights $t_i$ FIG. 3B illustrates the spectrum of the unit pulses produced by the fast discriminator 22 in response to output of the fast pulse amplifier 21 (step 4 in FIG. 2.). The width of a unit pulse is equal or less the digitizing time t of the transient recorder 24. FIG. 3C shows the attenuated and biased unit signals as they would recorded by the transient recorder and stored into the transient recorder memory (step 6 of FIG. 2.). The transient recorder 24 produces a high level signal at the different $t_i$ for the duration of the measuring interval dt. There is no signal recorded, i.e. a zero is stored, in the elapsed time intervals between successive detected particles. FIG. 3D shows an average spectrum which could be produced at the method step 7 for a number N repetitions of step 1–6 discussed in the forgoing. The height of the peaks is determined by the probabilities of releasing and detecting secondary species. The height divided by the height of a single recorded event represents the yield of the species, i.e. the mean number of released and detected species per primary ion pulse.

It will be understood that the above description of the present invention is susceptible to various modifications, changes and adaptations, and the same are intended to be comprehended within the meaning and range of equivalents of the appended claims.

What is claimed is:

1. An apparatus for counting individual particles in time-of-flight mass spectrometry, comprising:

means for producing secondary particles from a sample at a high repetition rate, means for accelerating the secondary particles;

detector means for detecting arrival of the secondary particles and producing an output signal indicating detection of a secondary particle, said output signal of said detector means having a magnitude which is independent of the number of simultaneously impinging secondary particles;

fast pulse amplifier means for amplifying the output signals from said detector means;

fast discriminator means for conversion of the amplified output signals produced by said fast pulse amplifier means into unit pulses;

shifting and attenuating means fed by said fast discriminator means for shifting and attenuating said unit pulses in a selected time relationship so that a noise-distorted base line of said unit pulses does not lie in a predetermined measuring range, and so that a plateau of said unit pulses lies in said predetermined measuring range;

a transient recorder means fed by said shifting and attenuating means, for producing an output signal at a high voltage level for a short time interval in response to each of the shifted and attenuated said unit pulses, representing a mass spectrum of the secondary particles.

2. An apparatus as claimed in claim 1, further comprising averaging means for forming an averaged spectrum for a plurality of recorded time spectra.

3. An apparatus as claimed in claim 1, further comprising display means for displaying said mass spectrum.

4. An apparatus as claimed in claim 1, further comprising storage means for storing said mass spectrum.

5. In a method of counting individual particles in time-of-flight mass spectrometry for secondary particles occurring at a high repetition rate after pulsed ion bombardment of a sample from which the secondary particles originate, in which a detector is operated to measure the time-of-flight of the secondary particles to the detector to determine a mass spectrum by producing an output signal indicating detection of a particle, in which the magnitude of the detector signal is independent of the number of simultaneously impinging secondary particles, and in which a recording means records all output signals from the detector after an individual ion bombardment of the sample, comprising the steps of:

(a) operating the detector after a pulse of the pulsed ion bombardment of the sample, to produce output signals upon detection of secondary particles;

(b) amplifying the output signals produced in step (a) using a fast pulse amplifier;

(c) conversion of the amplified output signals produced in step (b) by said fast pulse amplifier into unit pulses using a fast discriminator;

(d) shifting and attenuating the unit pulses produced in step (c) in a selected time relationship so that a noise-distorted base line of the unit pulses does not lie in a predetermined measuring range, and so that a plateau of the unit pulses produced in step (c) lies in said predetermined measuring range;

(e) producing a high voltage level for a predetermined short time interval in response to each of the shifted and attenuated unit pulses produced in step (c), using a transient recorder as a recording means so as to produce a mass spectrum; and (f) repeating steps (a) through (e) a plurality of times and then forming an average spectrum over a plurality of recorded time spectra determined at step (e).

6. A method as defined in claim 5, wherein in step (e) providing that the transient recorder can digitalize a measuring interval in 5 ns or less.

7. A method as defined in claim 5, wherein in step (c), providing that the sum of the rise and decay times of pulses produced by the fast pulse amplifier is always less than or equal to one measuring interval of the transient recorder.

8. A method as defined in claim 5, wherein in step (c), providing that a double pulse resolution of the discriminator pulses is less than a measuring interval of the transient recorder, and that the half-width of the discriminator pulse with respect to time is equal to or less than the measuring interval of the transient recorder.

* * * * *